US006000414A

United States Patent [19]

Crusor

[11] Patent Number: 6,000,414

[45] Date of Patent: Dec. 14, 1999

[54] CANE HOLDING APPARATUS AND METHOD

[76] Inventor: Jackie B. Crusor, 4834 Parkglen Ave., Los Angeles, Calif. 90043

[21] Appl. No.: 08/988,884

[22] Filed: Dec. 11, 1997

[51] Int. Cl.[6] ..... A45B 3/00

[52] U.S. Cl. ..... 135/66; 135/72; 135/75; 224/250; 224/904

[58] Field of Search ..... 135/65, 66, 15.1, 135/16, 17, 71, 72, 75, 76; 224/250, 235, 230, 240, 904, 620

[56] References Cited

U.S. PATENT DOCUMENTS

| | | | |
|---|---|---|---|
| 610,870 | 9/1898 | Quigley . | |
| 702,398 | 6/1902 | Bowyer | 224/250 X |
| 2,589,126 | 3/1952 | Payne | 224/250 X |
| 3,638,284 | 2/1972 | Baker . | |
| 3,892,251 | 7/1975 | Warfield . | |
| 4,220,302 | 9/1980 | Hampton et al. . | |
| 4,315,641 | 2/1982 | Larsen . | |
| 4,690,316 | 9/1987 | Peterson . | |
| 4,884,730 | 12/1989 | Carpenter | 135/66 X |
| 4,915,279 | 4/1990 | Galbraith | 224/230 |
| 4,958,758 | 9/1990 | Tipple et al. . | |
| 5,024,361 | 6/1991 | Flowers . | |
| 5,046,446 | 9/1991 | Sumrall et al. | 135/16 X |
| 5,121,865 | 6/1992 | Howard | 224/240 X |
| 5,353,977 | 10/1994 | Schiro, Jr. et al. | 135/16 X |
| 5,505,356 | 4/1996 | Noriega et al. . | |
| 5,555,904 | 9/1996 | Stockwell . | |
| 5,664,713 | 9/1997 | Burgstahler | 135/66 X |
| 5,671,765 | 9/1997 | Hagberg, Jr. . | |

OTHER PUBLICATIONS

Gershman, M., "Self–Adhering Nylon Tapes", J.A.M.A., v. 168, n.7, Oct. 18, 1958.

*Primary Examiner*—Carl D. Friedman
*Assistant Examiner*—Winnie S. Yip

[57] ABSTRACT

A cane holding apparatus and method for permitting a cane user to conveniently retain a cane free of the user's hands while maintaining the cane available for immediate use. A preferred embodiment of the cane holder apparatus includes a cane, hook-pile fastening material secured to the cane, a flexible panel adapted for being removably secured to a belt worn by the user, and loop-pile fastening means on the outerside of the worn panel for cooperating with the hook-pile fastening means on the cane for releasably securing the cane to the panel when the cane is placed to the panel with at least a portion of the hook-pile fastening material contacting at least a portion of the loop-pile fastening material.

12 Claims, 2 Drawing Sheets

CANE HOLDING APPARATUS AND METHOD

BACKGROUND OF THE INVENTION

This invention relates to a cane holding apparatus and method, and more particularly to an apparatus and method for permitting a cane user to conveniently retain a cane free of the user's hands while maintaining the cane ready for use.

A person who uses a cane for assistance in walking finds need, from time to time, to temporarily stow the cane so that he (or she) may use both hands free of the cane for performing other tasks, and in such manner that the cane is maintained available for immediate use. To rest the cane against a wall, table, counter or other support often results in awkward maneuvering of the cane, including the cane's slipping from its intended support and falling to the floor.

Although this problem is well known and long-standing, efforts toward its solution have resulted in such devices as a wrist strap with a detached loop cord for retaining the cane (see, for example, U.S. Pat. No. 4,958,758), or simply a looped wrist cord secured to the cane and/or in the vicinity of its handle or handgrip. Use of a wrist strap or wrist cord, however, does not provide a complete solution to the problem, since movement of one of the user's hands is constrained by virtue of the cane's attachment to the user's wrist.

SUMMARY OF THE INVENTION

By the present invention, cane holding apparatus is provided which permits the use of both hands while the cane is conveniently maintained available for immediate use. Briefly described, the apparatus according to the present invention comprises, in combination: a cane; first cooperative fastening means on the cane; a panel adapted for being worn by a person and having an outer side when worn; and second cooperative fastening means on the outer side of the panel for cooperating with the first cooperative fastening means for releasably securing the cane to the panel when the cane is placed to the panel with at least a portion of the first cooperative fastening means contacting at least a portion of the second cooperative fastening means. The panel is preferably flexible, and may be fabricated of a fabric, leather, or a flexible plastic sheet material such as vinyl. The cane includes a handgrip or handle, and the first cooperative fastening means is positioned on an upper portion of the cane below the handgrip. In one type of cane, the cane includes a shaft section, a handgrip section, and an intervening section between the shaft section and the handgrip section and angularly disposed from the shaft section; and the first cooperative fastening means is secured to the cane's intervening section.

In a preferred embodiment of apparatus according to the present invention, the first cooperative fastening means includes hook-pile fastening material secured to the cane, and the second cooperative fastening means includes loop-pile fastening material secured to the outer side of the panel. Such hook-pile fastening material and loop-pile fastening material cooperate with one another when in contact for releasably fastening the hook-pile and loop-pile fastening material to one another. Such cooperative loop-pile and hook-pile fasteners are preferably of the type sold under the trademark VELCRO®.

According to another aspect thereof, the present invention includes a method of retaining a cane when not in use, comprising the steps of: providing a cane, a strip of first cooperative fastening material, and a panel having second cooperative fastening material secured to a side thereof, the cooperative fastening materials being releasably fastenable to one another when in contact; removably securing the panel to a belt worn by a person with the side of the panel to which the second cooperative fastening material is secured outwardly facing; securing the strip of first cooperative fastening material to an upper portion of the cane at a location for contacting the second cooperative fastening material while the cane is lifted with its shaft substantially vertically disposed; and placing the cane with the strip of first cooperative fastening material contacting the second cooperative fastening material on the panel for releasably securing the cane to the panel worn by the person. The strip securing step may be performed by: holding the upper portion of the cane against the panel while lifting the cane with its shaft substantially vertically disposed and noting the location on the upper portion contacting the second cooperative fastening material; removing the cane from the panel; and securing the strip of first cooperative fastening material to the cane at the location on the upper portion noted during the holding step. The provided panel is preferably flexible and includes means such as a belt loop for removably securing the panel to the belt worn by the person for implementing the panel securing step. Further, the provided strip of first cooperative fastening material preferably comprises a hook-pile fastening material, and the second cooperative fastening material on the provided panel preferably comprises a loop-pile fastening material for cooperating with the hook-pile fastening material for being releasably fastened to one another when in contact.

BRIEF DESCRIPTION OF THE DRAWING

The novel features which are believed to be characteristic of the invention, together with further advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
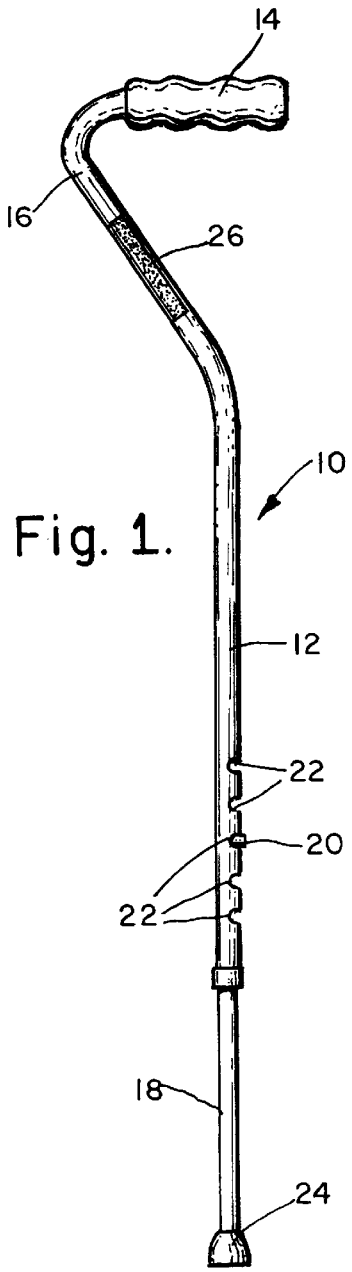
FIG. 1 is a side elevation view of one type of cane to which is secured a strip of hook-pile material for implementing a preferred embodiment of the present invention.

Turning first to FIG. 1, there is shown an example of a conventional walking stick or cane 10, which includes an elongate shaft section 12, a handgrip section 14, and an intervening section 16 between the shaft 12 and the handgrip 14 and inclined or angularly disposed from the shaft 12. The cane 10 is conventional in the art, as is its manner of use, and is typically fabricated of ⅞ inch outside diameter aluminum tubing. Such canes may be of adjustable height; for example, the shaft 12 may include a telescoping lower shaft portion 18 which is locked in place by a spring-biased pin 20 laterally extending from the telescoped shaft lower portion 18 through a selected one of a plurality of vertically spaced apertures 20 in the main portion of the shaft 12. The distal end of the shaft 12 conventionally includes an anti-skid tip member 24.

Figure 2:
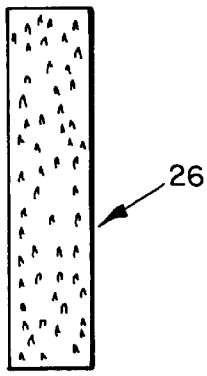
FIG. 2 is a front view of a strip of cooperative hook-pile fastening material which is shown in FIG. 1 secured to the cane.

Considering FIG. 2 along with FIG. 1, a strip of a cooperative hook-pile fastening material 26 is secured to the upper portion or intervening section 16 of the cane 10, preferably along the side of the cane 10 facing the user when the cane 10 is normally held by the user for walking. The strip 26 may be secured to the cane 10 by conventional means such as by gluing. In a preferred example, a hook-pile strip 26 includes the hook-pile on a front side thereof and further includes an adhesive backing, i.e. an adhesive coated on the reverse side thereof; accordingly, a preferred manner of securing the hook-pile tape 26 to the cane 10 is to press the tape 26 to the cane's upper portion or angled intervening section 16 with the tape's adhesive backing in contact with the cane's surface.

Figure 3:
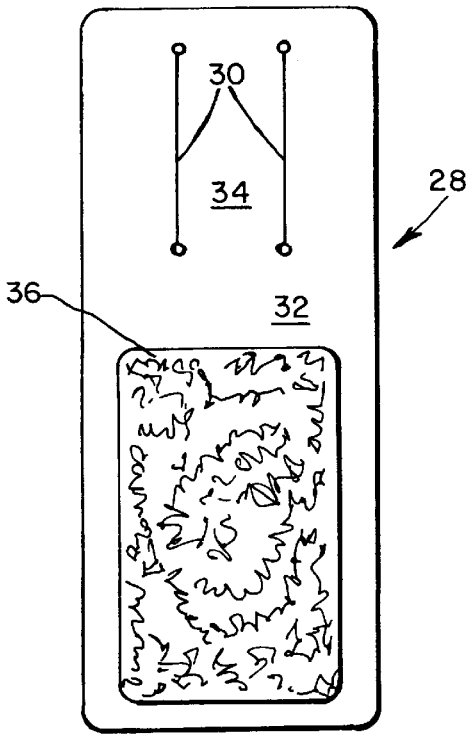
FIG. 3 is a front elevation view of a panel adapted for securement to a user's belt and including cooperative loop-pile fastening material thereon in accordance with the preferred embodiment of the present invention.

Referring to FIG. 3, a cane holder panel 28 is preferably of a flexible material such as fabric, leather or plastic sheet (e.g., polyvinyl chloride or vinyl). The panel is preferably rectangular in configuration, and includes a pair of vertical slits 30, with the material between the slits 30 functioning as a belt loop 34 for permitting the panel 28 to be worn by the cane user by threading the user's worn belt through the slits 30. The panel 28 has an outer side 32 when so worn by the person or user, and a swatch of loop-pile fastening material 36 is secured to the outer side 32 of the panel 28 by conventional means such as by sewing or gluing. For example, a generally rectangular swatch of loop-pile fastening material 36 having an adhesive backing may be pressed upon the outer surface or side 32 of the panel 28 with the swatch's adhesive backing in contact with the panel's outer side 32.

Such hook-pile fastening material 26 and loop-pile fastening material 36 complement or cooperate with one another for providing a releasable fastener when in contact, as is well known and such as marketed under the trademark VELCRO®. As used herein, the terms "loop-pile" and "hook-pile" refer to such complementary or cooperative fastening materials such as marketed under the trademark VELCRO®. Loop-pile and hook-pile tape or swatch material, conventionally fabricated of nylon, with adhesive backings are also marketed under the trademark VELCRO®.

Figure 4:
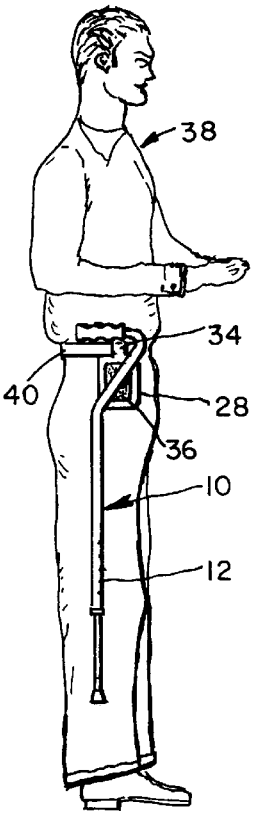
FIG. 4 is a side view of a person or cane user, showing the apparatus of the preferred embodiment in use.
Figure 5:
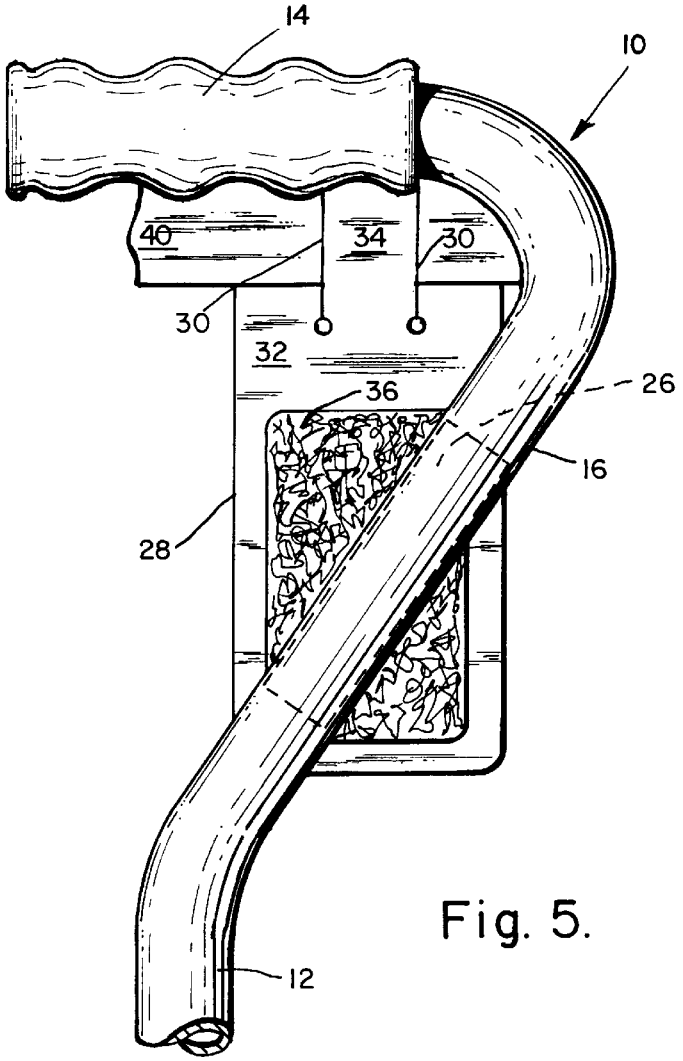
FIG. 5 is a fragmentary side elevation view of the modified cane and belt-worn panel shown in use as in FIG. 4 but enlarged for clarity of description.

In use, and as shown in FIGS. 4 and 5, a cane user or person 38 may secure the cane 10 to his person when not in use so that his hands are free for other tasks. The person 38 secures the panel 28 to his worn belt 40 by threading the belt 40 through the panel's belt loop 34, preferably on the person's side that he uses the cane. When the person 38 desires to free his hands from holding the cane 10, he lifts the cane 10 such that the shaft 12 is generally vertically oriented and with the strip of hook-pile material 26 for contacting the loop-pile material 36 on the outer side 32 of the worn panel 28. The person causes at least a portion of the hook-pile material 26 secured to the cane 10 to contact at least a portion of the loop-pile material 36 secured to the worn panel 28, by pressing or "slapping" the cane's upper portion 16 against the worn panel 28.

In the preferred panel embodiment 28, the flexible nature of the panel 28 may permit the loop-pile material 36 to partially conform to the convex surface of the cane-supported hook-pile material 26 when the cane is pressed or slapped against the worn panel 28. This would tend to increase the contact area between the hook-pile material 26 and the loop-pile material 36, strengthening the securement of the cane 10 to the panel 28.

When the person 38 desires to again use the cane 10, he may disengage the cane 10 from the panel 28 (i.e., he may release the hook-pile material 26 from the loop-pile material 36) by coercing the cane 10 outwardly from his body in the vicinity of the panel 28, for example by pushing the cane's handgrip 14 outwardly while causing the bottom of the shaft 12 to contact the user's leg.

In a preferred manner of practicing the method of the present invention of retaining a cane when not in use, the hook-pile fastening strip 26 is secured to the upper portion 16 of the cane 10, by first holding the cane's upper portion 16 against the worn panel 28 while lifting the cane 10 with its shaft 12 substantially vertically disposed and noting the location on the cane's upper portion or intervening section 16 contacting the loop material 36 on the panel 28. The cane 10 is then removed from the panel 28, and the strip of hook-pile material 26 is fastened to the cane 10 at the noted location on the cane's upper portion or intervening section 16. As noted earlier, such fastening or securement of the hook-pile strip 26 may be conveniently implemented by using a strip 26 having an adhesive backing as commercially marketed under the trademark VELCRO®.

In one example of components of the preferred embodiment according to the present invention, the upper portion or intervening section 16 of the cane 10 was approximately 9 inches along the vertical direction; the strip of hook-pile material 26 was approximately ¾ inch in width and 3½ inches in length. In that example, the flexible panel 28 was generally rectangular in configuration, of approximately 2¾ inches in width and approximately 7 inches in height, with the swatch of loop-pile material 36 being approximately 2 inches in width and 3½ inches in height; the slits 30 were approximately 2 inches in height and spaced apart to define a belt loop 34 of approximately 1 inch in width.

Thus, there has been described a preferred embodiment of an apparatus and method for permitting a cane user to conveniently retain a cane free of the user's hands while maintaining the cane available for immediate use. Other embodiments and configurations of the apparatus and method may be developed without departing from the essential characteristics thereof. For example, other cane configurations may be employed, such as a conventional wood or metal cane comprising a handgrip or handle and a vertical shaft without an inclined intervening section. Further, the strip of hook-pile material secured to the cane may completely encircle the cane; and the hook-pile material may alternatively be secured to the panel while the loop-pile material secured to the cane, although not preferred. Accordingly, the invention should be limited only by the scope of the claims listed below.

I claim:

1. An apparatus for releasably retaining a cane to a belt worn by a person, comprising in combination:

a cane;

first cooperative fastening material secured to said cane;

a panel adapted to be removably secured to the belt worn by the person and having an outer side when secured to the belt; and second cooperative fastening material secured to said outer side of said panel cooperating with said first cooperative fastening material for releasably securing said cane to said panel when said cane is placed to said panel secured to the belt worn by the person with at least a portion of said first cooperative fastening material contacting at least a portion of said second cooperative fastening material.

2. The apparatus according to claim 1, wherein:

said panel is flexible.

3. The apparatus according to claim 1, wherein:

and said cane includes a handgrip and said first cooperative fastening material is positioned on an upper portion of said cane below said handgrip.

4. The apparatus according to claim 1, wherein:

said cane includes a shaft section, a handgrip section, and an intervening section between said shaft section and said handgrip section and angularly disposed from said shaft section; and said first cooperative fastening material is secured to said intervening section of said cane.

5. The apparatus according to claim 1, wherein:

said first cooperative fastening material includes hook-pile fastening material; and said second cooperative fastening material includes loop-pile fastening material.

6. An apparatus for releasably retaining a cane to a belt worn by a person, comprising in combination:

a cane;

hook-pile fastening material secured to said cane;

a flexible panel adapted to be removably secured to the belt worn by the person and having an outer side when secured to the belt; and loop-pile fastening material on said outer side of said panel cooperating with said hook-pile fastening material for releasably securing said cane to said panel when said cane is placed to said panel secured to the belt with at least a portion of said hook-pile fastening material contacting at least a portion of said loop-pile fastening material.

7. The apparatus according to claim 6, wherein:

said cane includes a handgrip and said hook-pile fastening material is secured to an upper portion of said cane below said handgrip.

8. The apparatus according to claim 6, wherein:

said cane includes a shaft section, a handgrip section, and an intervening section between said shaft section and said handgrip section and angularly disposed from said shaft section; and said hook-pile fastening material is secured to said intervening section of said cane.

9. A method of retaining a cane when not in use, comprising the steps of:

providing a cane, a strip of first cooperative fastening material, and a panel having second cooperative fastening material secured to a side thereof, said cooperative fastening materials being releasably fastenable to one another when in contact;

removably securing said panel to a belt worn by a person with said side of said panel outwardly facing;

securing said strip of first cooperative fastening material to an upper portion of said cane at a location for contacting said second cooperative fastening material while said cane is lifted with its shaft substantially vertically disposed; and placing said cane with said strip of first cooperative fastening material contacting said second cooperative fastening material on said panel for releasably securing said cane to said panel worn by the person.

10. The method according to claim 9, wherein the strip securing step comprises the steps of:

holding the upper portion of said cane against said panel while lifting said cane with its shaft substantially vertically disposed and noting the location on said upper portion contacting said second cooperative fastening material;

removing said cane from said panel; and securing said strip of first cooperative fastening material to said cane at the location on said upper portion noted during the holding step.

11. The method according to claim 9, wherein:

during the providing step, the provided strip of first cooperative fastening material comprises a strip of hook-pile fastening material, and said second cooperative fastening material on the provided panel comprises loop-pile fastening material.

12. The method according to claim 11, wherein:

during the providing step, the provided panel is flexible and includes means for removably securing said panel to the belt worn by the person for implementing the panel securing step.

* * * * *